US005938141A

United States Patent [19]

Kanbar

[11] Patent Number: 5,938,141

[45] Date of Patent: Aug. 17, 1999

[54] HOLDER FOR PAPER TOWEL ROLL

[76] Inventor: Maurice S. Kanbar, 2140 Pacific Ave., Apt. #503, San Francisco, Calif. 94115

[21] Appl. No.: 09/105,184

[22] Filed: Jun. 26, 1998

[51] Int. Cl.[6] ..... B65H 23/06

[52] U.S. Cl. ..... 242/423.1; 242/597.7; 242/613.5; 242/614; 206/416

[58] Field of Search ..... 242/423, 423.1, 242/423.2, 588, 588.3, 588.6, 590, 596, 596.1, 596.3, 597, 597.7, 598.1; 206/397, 408, 413, 414, 415, 416

[56] References Cited

U.S. PATENT DOCUMENTS

| | | |
|---|---|---|
| 686,324 | 11/1901 | McKay . |
| 1,345,190 | 6/1920 | Hutchison . |
| 3,116,030 | 12/1963 | Leotta . |
| 4,487,376 | 12/1984 | Compton . |
| 4,690,345 | 9/1987 | Cotey . |
| 4,720,053 | 1/1988 | Vance . |
| 4,738,385 | 4/1988 | Bell . |
| 4,762,288 | 8/1988 | Eckels . |
| 4,792,102 | 12/1988 | Olson . |
| 5,605,304 | 2/1997 | Ahern, Jr. . |
| 5,755,397 | 5/1998 | Freese . |
| 5,788,136 | 8/1998 | Othman . |
| 5,794,882 | 8/1998 | Lewis . |

*Primary Examiner*—Donald P. Walsh
*Assistant Examiner*—William A. Rivera
*Attorney, Agent, or Firm*—Michael Ebert

[57] ABSTRACT

A holder for a paper towel roll in which wound about a tubular core is a band of absorbent paper sheeting divided by perforation lines into a series of interconnected towel sections. The roll is rotatably supported by the holder to permit a user to unwind the leading towel section from the roll and tear it off. To facilitate extraction of a single towel section from the roll without causing it to further unwind, a stop element is provided. The element is formed by a cap and a plug projecting therefrom, the plug being received in one end of the tubular core whereby the cap then abuts an end of the roll. In operation, as the user with one hand tears off the unwound leading section of the roll, with his other hand presses the cap of the stop element to arrest rotation of the roll and further unwinding thereof.

7 Claims, 2 Drawing Sheets

HOLDER FOR PAPER TOWEL ROLL

BACKGROUND OF INVENTION

1. Field of Invention

This invention relates generally to holders for paper towel rolls, and in particular to a holder adapted to dispense a single towel section of the roll at a time.

2. Status of Prior Art

A ubiquitous household artifact is a paper towel roll, for there are numerous practical uses for paper towel sections torn off this roll. A great advantage of a disposable paper towel is that it can be discarded after a single use, whereas the cost of cloth towel is, such that the towel is not disposable and must be cleaned before it can be reused.

A paper towel roll consists of a long band of absorbent paper sheeting wound about a tubular core, usually formed of cardboard. The band is perforated by equi-spaced transverse lines along its length to define a series of interconnected paper towel sections. To withdraw from the roll a single towel section, the leading section must be unwound from the roll and torn off.

In some households, no holder therefor is provided and a paper towel roll is just seated upright on a counter, say in the kitchen, so that it is available for use. In order to tear off a single towel section, the user must pick up the roll, tear off a single towel section and then place the roll back on the counter. This practice has the same drawbacks as are experienced with a roll of toilet paper placed on a counter in a bathroom rather than in a toilet paper holder a far more convenient paper dispenser.

There are two known types of paper towel roll holders for dispensing paper towel sections. In a horizontal holder, which typically is attached to the underside of a kitchen cabinet, the holder consists of a base plate having a pair of arms projecting from its opposite ends. The arms which are flexible are provided with bearings that fit into the ends of the tubular core of the paper towel roll, so that the roll is rotatable on the bearings of the holder. To replace an exhausted roll, one flexes the arms to cause the bearings to enter into the ends of the tubular core of a fresh roll.

In order to separate the leading towel section from a roll supported for rotation in a horizontal holder, the user pulls on this section to unwind it from the roll and then with a wrist snap action, tears this section from the roll.

But a common experience when a user takes this action is for the roll to unwind to dispense several towel sections rather than just the leading towel section. This makes it necessary for the user to rewind the roll. One objection to this practice is that the user's hands are often wet, especially in the kitchen, and should it become necessary for him to rewind the roll, the user in doing so, may wet and possibly soil the rewound sections.

The tendency of a paper towel roll to unduly unwind beyond the point necessary to obtain a single towel section depends on the inertia of the roll. This inertia is greatest when the roll is fresh and has a maximum diameter. Then a force applied to the roll to tear off a towel section will usually not overcome this inertia; hence any further unwinding of the roll will not occur. But as the diameter of the roll diminishes with use, the inertia of the roll is reduced and a point is reached, where a pulling force applied to the advance section of the roll will cause the roll to unwind to dispense several sections of the roll.

Similar problems are experienced with a vertical holder for a paper towel roll, which include a vertical shaft that telescopes into one end of the tubular core of the roll. The paper roll is then rotatable about a vertical axis, and a pulling force intended to dispense a single towel section may cause many more sections to unwind.

SUMMARY OF INVENTION

In view of the foregoing, the main object of this invention is to provide a holder for a paper towel roll adapted to dispense a single paper towel section at a time.

More particularly, an object of this invention is to provide both a horizontal and a vertical holder for a paper towel roll which includes a stop element to facilitate the separation from the roll of one towel section at a time.

Also an object of the invention is to provide paper towel holders of the above type which are inexpensive to manufacture, and operate efficiently and reliably.

Briefly stated, these objects are attained by a holder for a paper towel roll in which wound about a tubular core is a band of absorbent paper sheeting divided by perforation lines into a series of interconnected towel sections. The roll is rotatably supported by the holder to permit a user to unwind the leading towel section from the roll and tear it off.

To facilitate extraction of a single towel section from the roll without causing it to further unwind, a stop element is provided. This element is formed by a cap and a plug projecting therefrom, the plug being received in one end of the tubular core whereby the cap then abuts an end of the roll. In operation, as the user with one hand tears off the unwound leading section of the roll, the user with his other hand presses the cap of the stop element to arrest rotation of the roll and further unwinding thereof.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
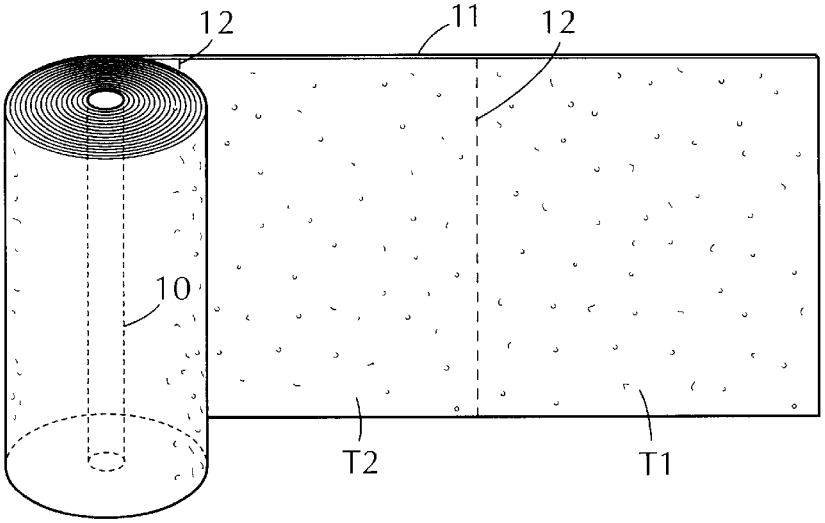
FIG. 1 illustrates a typical paper towel roll, partially unwound.

FIG. 1 shows a paper towel roll of a type that is commercially available. The roll consists of a tubular core 10 usually formed of cardboard, about which is wound a long band 11 of absorbent paper sheeting suitable for towels. The paper band is perforated at equi-spaced positions along its length by transverse lines 12 to define a series of interconnected paper towel sections $T_1$, $T_2$, etc. all having the same rectangular size.

In order to extract a towel section from the roll, the user unwinds from the roll its leading section (section $T_1$) and tears it off to extract it from the roll. When leading section $T_1$ is torn off, then the leading section of the roll becomes the next section $T_2$, and so on, until the roll is exhausted.

With continued use of the roll, its maximum diameter, when the roll is fresh, progressively diminishes until what remains of the roll is the small diameter tubular core 10. As pointed out above, when a roll is rotatably mounted on a holder, its inertia depends on the diameter of the roll, and when a holder successively dispenses paper towel sections, the inertia of the roll is reduced to a degree where the roll on the dispenser, in reaction to a pulling force, tends to unwind several towel sections rather than a single section.

In all embodiments of a holder for dispensing paper towel section to be hereinafter disclosed, the holder is provided with stop means to limit the paper towel that is dispensals to a single section, making it unnecessary to rewind the roll to retract sections that should not have been dispensed.

I. Vertical Holder (First Embodiment)

Figure 2:
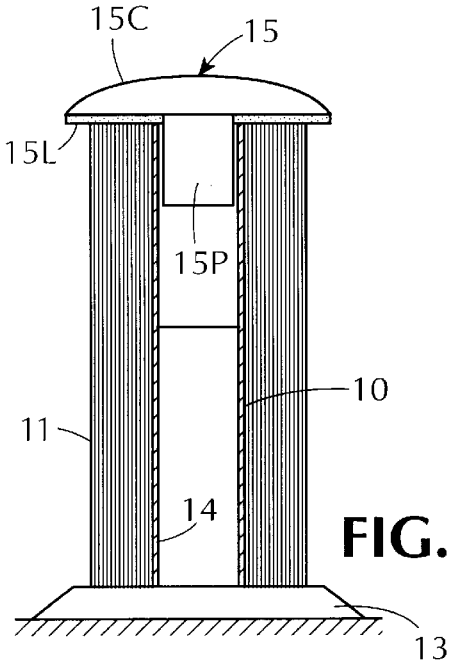
FIG. 2 is a section taken through one embodiment of a vertical holder for a paper towel roll in accordance with the invention, the holder including a stop element.
Figure 3:
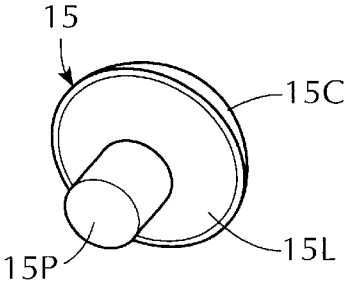
FIG. 3 is a separate view of the stop element.
Figure 2A:
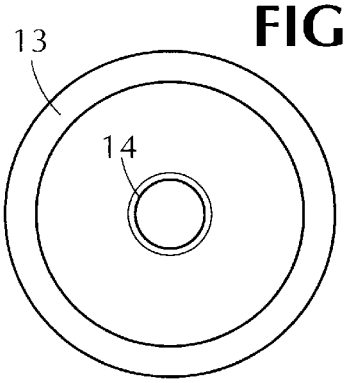
FIG. 2A is a plan view of the underside of the stop element shown in FIG. 2.

In the embodiment of a vertical holder for a paper towel roll, as shown in FIGS. 2 and 2A, the holder which is adapted to dispense a single towel section at a time includes a pedestal 13 having a frusto-conical shape that rests on a counter or other horizontal surface. Anchored vertically on pedestal 13 and coaxial therewith is a hollow shaft 14 whose length is about the same as the length of the paper towel roll supported for rotation on the shaft. The outer diameter of hollow shaft 14 of the holder is somewhat less than the inner diameter of the core 10 of the paper towel roll which loosely fits over the core. Hence the roll is free to rotate on its vertical holder.

To control rotation of the roll on its vertical holder, a stop element 15 is provided having a dome-shaped cap 15C from whose flat underside is projected a short cylindrical plug 15P. The diameter plug 15P is somewhat smaller than the inner diameter of tubular core 14 of the paper towel roll. The underside of cap 15C is coated with a layer 15L of sponge rubber or other high-friction, compressible material, such as open-cell flexible foam plastic.

Hence when stop element 15 is seated on top of the erect paper towel roll, as shown in FIG. 2, plug 15P of this element is loosely received within the upper end of core 14 of the roll and the high-friction layer 15L on the underside of cap 15C rests on the upper end of the convoluted paper band wound about the core.

Stop element 15 performs two useful functions. In its static state with the high friction underside of cap 15C resting on the convolutions of the paper band wound about core 10 of the roll, the stop element then acts to prevent the roll from unwinding. This is a common problem with conventional vertical holders for paper towel rolls, for there is nothing to restrain uncoiling of the roll.

The second function of stop element take place in the active state of the holder when a user with one hand pulls the leading section of the roll to unwind the roll so that its leading section can then be torn off along the line of perforation. In order to prevent the force of this action from further unwinding the roll, the user with the palm of his other hand presses cap 15C of the stop element to frictionally engage the upper end of the vertically-mounted roll with sufficient force to prevent it from turning. It actually takes little pressure to effect this stop action.

Thus the force applied by one hand of the user to pull out and tear-off the leading towel section from the roll is prevented by the other hand of the user from further unwinding the roll.

II. Vertical Holder (Second Embodiment)

Figure 5:
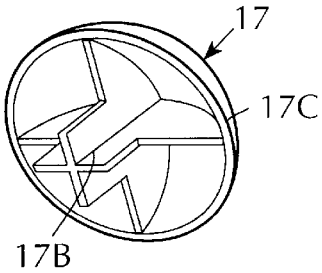
FIG. 5 is an underside view of a stop element for the holder shown in FIG. 4.
Figure 6:
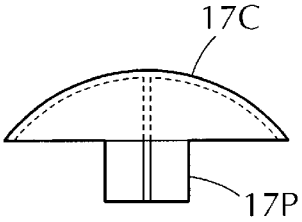
FIG. 6 is an elevational view of the stop element shown in FIG. 5.
Figure 4:
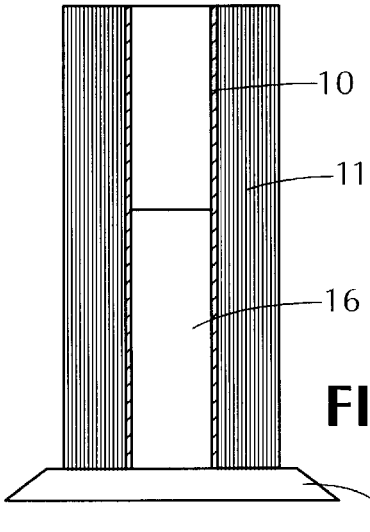
FIG. 4 is a section taken through a second embodiment of a vertical holder for a paper towel roll in accordance with the invention, the stop element for this holder being omitted.

In a second version of a vertical holder, as shown in FIGS. 4, 5 and 6, the paper towel roll is fitted onto a relatively short shaft 16 vertically anchored on pedestal 13. The diameter of shaft 16 which telescopes within the lower end of tubular core 10 of the roll is somewhat smaller than the inner diameter of the core; hence the roll is rotatable on a vertical axis about this shaft.

Associated with this holder is a stop element 17 having a dome-shaped cap 17C and a plug 17P projecting therefrom having a four-bladed cruciform shape. The dimensions of plug 17P are such that when plug 17P is pressed into the hollow upper end of core 10 of the roll, the plug is then jammed into the core.

Hence in this embodiment, stop element 17 is effectively attached to the upper end of the roll and rotates with it. However, when a user wishes to extract a single paper towel section from the roll, and unwinds this leading section from the roll with one hand, he presses the cap of the stop element 17 with his other hand to prevent the roll from turning to further unwind the roll as the teaching section is being torn off the roll.

Figure 7:
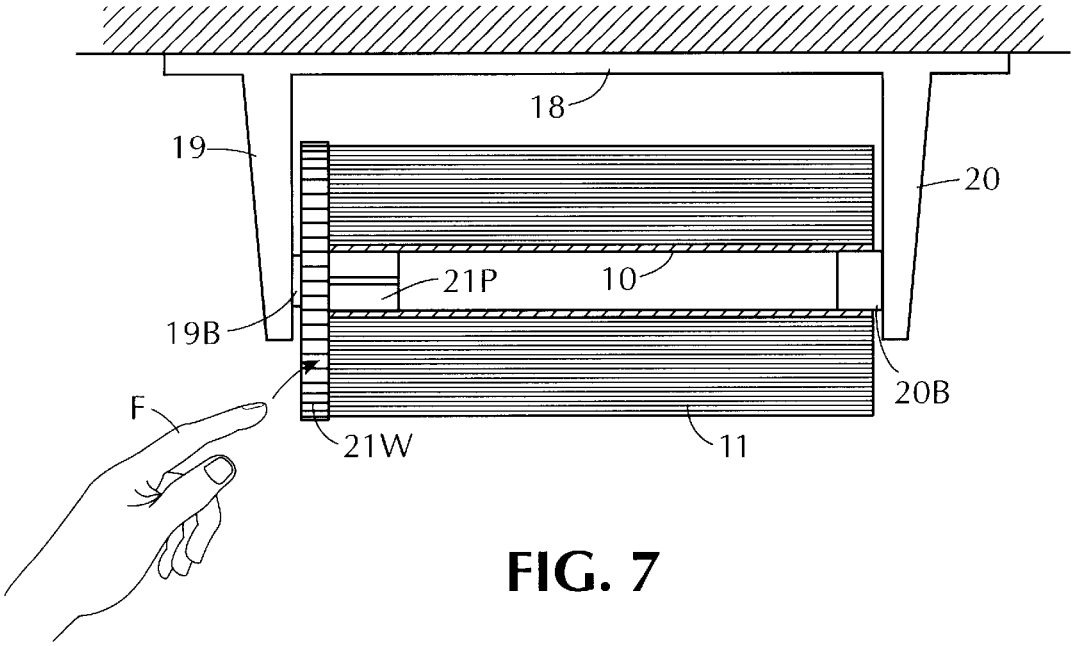
FIG. 7 illustrates a horizontal holder for a paper towel roll in accordance with the invention.
Figure 8:
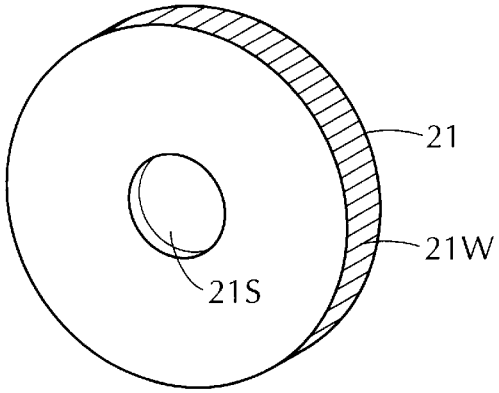
FIG. 8 illustrates one side of the stop element for the holder shown in FIG. 7.
Figure 9:
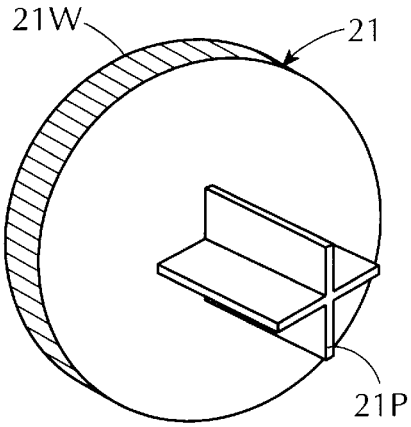
FIG. 9 illustrates opposite side of the stop element shown in FIG. 7.

III. Horizontal Holder:

In the horizontal holder for the paper towel roll shown in FIG. 7, the holder is provided with a platform plate 18 which is attached to a horizontal surface, such as the underside of a cabinet mounted in a kitchen above a counter. In this way, a kitchen worker, when in need of a towel, can tear off a paper towel section from a roll supported by the holder.

Projecting from opposing ends of platform plate 18 of the horizontal holder are two arms 19 and 20, each supporting a cylindrical bearing 19B and 20B, respectively.

In a conventional horizontal holder, arms 19 and 20 are flexible, and to install a paper towel roll in this holder, the arms are flexed to socket the cylindrical bearings in the opposing ends of the tubular core 10 of the roll, so that the roll is then free to turn on the bearings. But the drawback to this conventional arrangement is the tendency of the roll to unwind to a greater extent than is necessary to a dispense a single towel section.

To control the unwinding of the roll, a horizontal holder in accordance with the invention includes a stop element 21 having a wheel-shaped cap 21W provided with a corrugated rim. Projecting from one side of cap 21W is a plug 21P having a cruciform shape which jams into one end of the tubular core 10 of the roll. Hence the wheel-cap 21W is joined to and rotates with the roll on the bearings 19B and 20B of the holder. The other side of the wheel-shaped cap 21W is provided at its hub with a circular socket 21S which accommodates bearing 19B of the holder, the diameter of the socket being slightly greater than that of the bearing. Hence stop element 21 does not interfere with the ability of the paper towel roll mounted on the horizontal holder to rotate.

However, all a user need do to prevent the roll from further unwinding after the user has unwound a single leading section from the roll, is to press with a finger of his hand, the wheel cap 21W of the stop element to arrest rotation of the roll. Thus the roll is held by one hand as the leading section of the roll is being torn off by the other hand of the user.

Existing horizontal towel holders can be retrofitted with a stop element to become a horizontal holder in accordance with the invention. But in that event, the wheel-cap 21W of the stop element should be relatively thin so that it lies within the tolerances of the exiting holder to accept the interposition of the wheel between the bearing 19B and the corresponding end of the tubular core 10.

The wheel-cap 21W which frictionally engages the convoluted paper end of the roll and may have a rough surface. This rough surface helps the finger to prevent the roll from turning.

While there have been disclosed paper towel roll holders in accordance with the invention, it is to be understood that many changes may be made therein without departing from the spirit of the invention.

I claim:

1. A holder for a paper towel roll in which a band of paper sheeting is wound about a tubular core to define a coil having a series of interconnected towel sections, said holder which is adapted to dispense one towel section at time comprising:

A. means to rotatably support the roll to permit a user to unwind a leading towel section from the roll and tear it off; and B. a stop element formed by a cap covering the diameter of the roll and having a flat undersurface and a plug projecting therefrom wherein the underside of the cap around the plug is coated with a layer of sponge rubber, the plug being received in one end of the tubular core whereby the undersurface of the cap then abuts and frictionally engages the coil at an end of the roll and acts to resist uncoiling of the roll when the holder is not in use, whereby when the holder is in use and the user tears off the unwound leading towel section of the roll with one hand, he can with his other hand then press the cap to arrest rotation of the roll and further unwinding thereof.

2. A holder as set forth in claim 1, including a pedestal that can be rested on a horizontal surface and a hollow vertical shaft anchored on the pedestal on which is mounted the tubular core of the roll whereby the roll is rotatable on a vertical axis about the shaft.

3. A holder as set forth in claim 2, in which the undersurface of the cap is provided with a friction layer to prevent the roll from rotating when the cap is pressed by the user.

4. A holder as set forth in claim 2, in which the plug is configured to jam into said end of the tubular core whereby the stop element is then attached to the roll and rotates therewith.

5. A holder as set forth in claim 4, in which the plug has a cruciform configuration.

6. A holder as set forth in claim 1, in which the cap is dome-shaped.

7. A holder as set forth in claim 1, wherein the cap has a convex upper surface to accommodate the palm of said other hand.

* * * * *